US007207372B2

(12) United States Patent
Dorest

(10) Patent No.: US 7,207,372 B2
(45) Date of Patent: Apr. 24, 2007

(54) GARAGE DOOR VENTILATION APPARATUS

(76) Inventor: Hamilton Dorest, 16310 Quailynn Ct., Missouri City, TX (US) 77489

( * ) Notice: Subject to any disclaimer, the term of this patent is extended or adjusted under 35 U.S.C. 154(b) by 0 days.

(21) Appl. No.: 10/840,591

(22) Filed: May 7, 2004

(65) Prior Publication Data

US 2004/0250967 A1 Dec. 16, 2004

Related U.S. Application Data

(63) Continuation-in-part of application No. 09/714,711, filed on Nov. 17, 2000, now abandoned.

(51) Int. Cl.
*E06B 7/28* (2006.01)

(52) U.S. Cl. ..... 160/180; 52/208; 160/89

(58) Field of Classification Search ..... 160/90, 160/180, 89; 49/404, 413; 52/208, 204.65
See application file for complete search history.

(56) References Cited

U.S. PATENT DOCUMENTS 4,924,628 A * 5/1990 Ruby et al. ..... 49/380
4,999,957 A * 3/1991 Kessler ..... 52/213

* cited by examiner

*Primary Examiner*—Blair M. Johnson
(74) *Attorney, Agent, or Firm*—Kenneth D. Baugh

(57) ABSTRACT

A ventilation apparatus 26 is provided for mounting in a garage 10 door. The ventilation apparatus is provided with a rectangular shaped base support member 30 having an opening 40 formed therein. A first rectangular shaped tracking member 54 is aligned in first portions of the opening 40 in the base member 30. The ventilation apparatus 26 is also provided with a first transparent member 66 which is coupled in the first tracking member 54. A second rectangular shaped tracking member 56 is aligned in second portions of the opening 40 in the base support member 30. A second transparent member 82 is mounted for slidable movement in the second tracking member 56. This allows the second transparent member 82 to be moved to a position to cover the second portions of the opening 40 in the base member 30 as well as be moved to a position so that the second portions of the opening in the base member are uncovered.

11 Claims, 4 Drawing Sheets

GARAGE DOOR VENTILATION APPARATUS

This application is a continuation in part of my U.S. patent application Ser. No. 09/714,711 filed on Nov. 17, 2000 now abandoned.

TECHNICAL FIELD

This invention relates to a garage door and a garage door ventilation apparatus to be used on the garage door to facilitate air flow inside the garage area when the door is closed. The garage area of a home is a very important and popular area of the home for various reasons. It is very popular for use as a work area for working on automobiles, working on household projects and other such activities. It is also popular for use as a recreational area. In these kinds of activities it is often desirable to have the garage area closed in by keeping the door down. However keeping the garage door down can often make it uncomfortable while the desired activity is being performed.

BACKGROUND ART

Attempts have been made to provide garage doors to facilitate ventilation in a garage door area when the door is closed. One such door is disclosed in U.S. Pat. No. 3,927,709. Such doors are provided with a series of holes in the garage door which are covered by a permanently mounted screen. The use of such a device requires the total replacement of the existing garage door. Accordingly, these devices can not be readily used to facilitate ventilation in the garage areas where it is not desirable to replace the entire door.

Other attempts have been made to provide ventilation in garage doors by cutting out portions of the garage door assemblies and installing windows in the existing panels. Such an arrangement is disclosed in U.S. Pat. No. 5,497,588. Although this is a workable arrangement it is not necessarily desirable because it can be costly.

DISCLOSURE OF THE INVENTION

A ventilation apparatus is provided for mounting in a garage door. The ventilation apparatus is provided with a rectangular shaped base support member having an opening formed therein. A first rectangular shaped tracking member having an opening formed therein is aligned in first portions of the opening in the base member. The ventilation apparatus is also provided with a first transparent member which is coupled in the opening in the first tracking member. A second rectangular shaped tracking member having an opening formed therein is aligned in second portions of the opening in the base support member. A second transparent member is mounted for slidable movement in the opening in the second tracking member. This allows the second transparent member to be moved to a position to cover the second portions of the opening in the base member as well as moved to a position so that the second portions of the opening in the base member are uncovered.

BRIEF DESCRIPTION OF THE DRAWING

The details of the invention will be described in connection with the accompanying drawing in which.

BEST MODE FOR CARRYING OUT THE INVENTION

Figure 1:
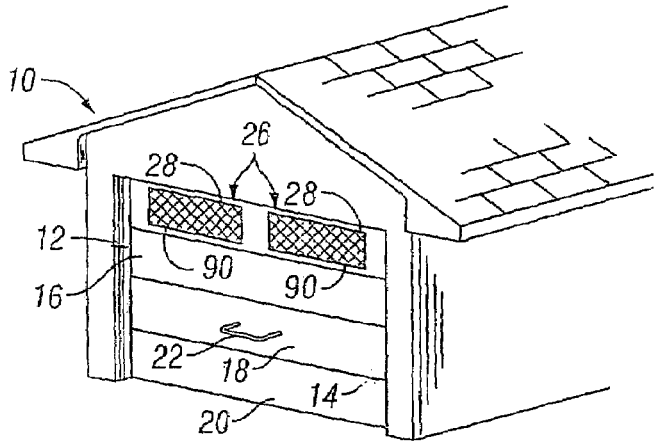
FIG. 1 is a perspective view illustrating a garage including a garage door ventilation apparatus illustrated in a garage door in accordance with the principles of the invention.

Referring to FIG. 1 there is shown, a garage, generally designated, by the numeral 10, including a garage door, generally designated, by the numeral 12. The garage door 12 is slidably mounted in a well known manner in a garage door opening (shown covered). The garage door 12 is provided with a plurality of panels 14, 16, 18 and 20. A handle 22 for facilitating raising and lowering the garage door 12 is formed on the panel 18. A pair of ventilation panels, generally designated, by the numeral, 26 are horizontally aligned and coupled in the garage door panel 14 of the garage door 12 in openings 28 formed therein.

Figure 2:
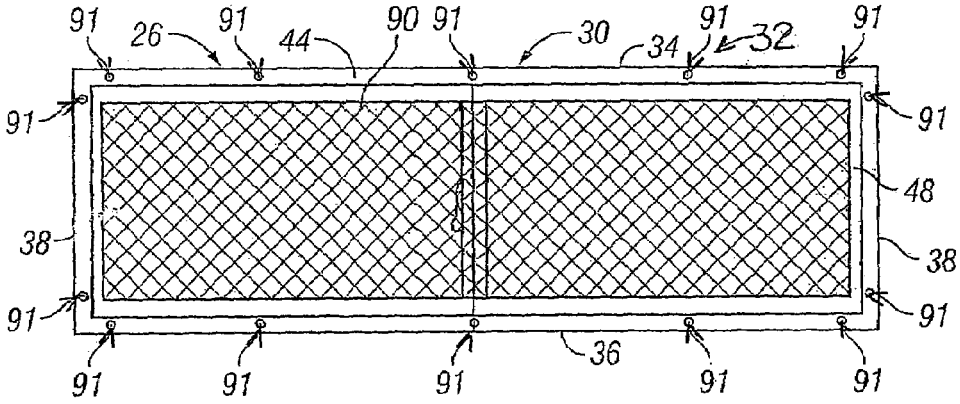
FIG. 2 is a front plain view of a garage door ventilation apparatus in accordance with the principles of the invention.
Figure 3:
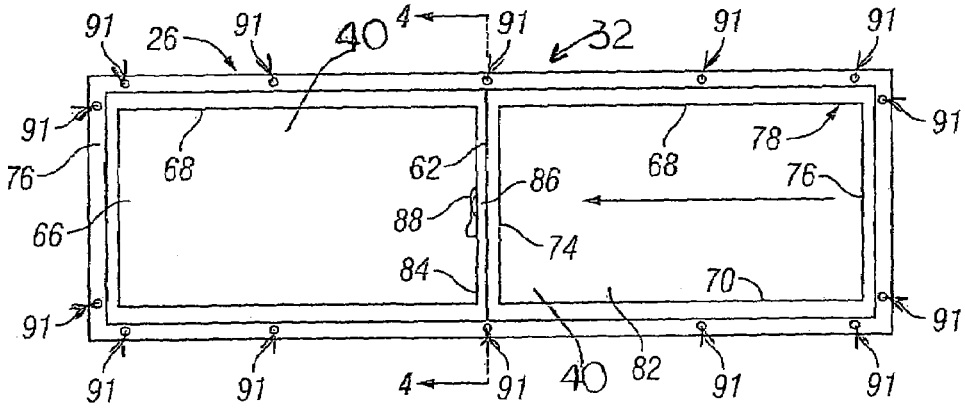
FIG. 3 is a front plain view of a garage door ventilation apparatus with a screen member removed in accordance with the principles of the invention.
Figure 4:
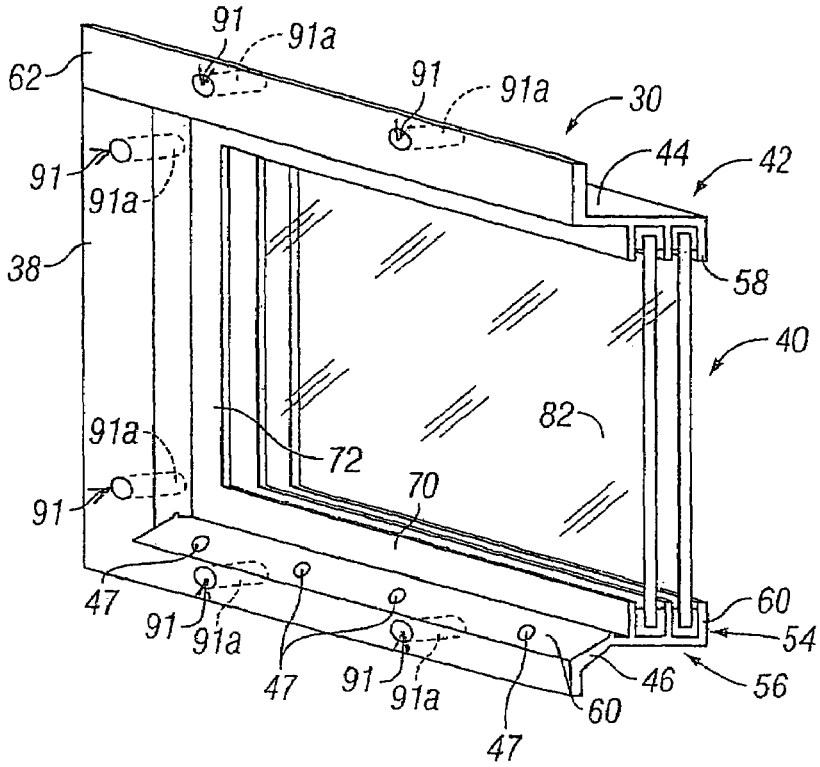
FIG. 4 is a cut-away view taken along line 4—4 of FIG. 3.

As illustrated in FIGS. 2,3 and 4 the ventilation panel 26 is provided with a support or frame assembly member, generally designated, by the numeral, 30. The frame member 30 is provided with a first rectangular planar shaped frame member generally designated, by the numeral 32. The planar shaped member 32 is provided with an upper horizontally extending member 34 and a spaced lower horizontally extending member 36. The planar shaped member 32 is also provided with a vertically extending member 38 coupled between each end of the horizontally extending members 34 and 36 thereby forming a frame opening, generally designated, by the numeral, 40 therebetween.

The frame assembly 30 is also provided with a second rectangular shaped frame member generally designated, by the numeral 42. The second frame member 42 is provided with an upper horizontally extending member 44 and a spaced lower horizontally extending member 46. The spaced lower horizontally extending member has a downward pitch so that excess water will not accumulate on the ventilation panel 26. The spaced lower horizontally extending member 46 also has a plurality of apertures 47 to further prevent the accumulation of excess water on the ventilation apparatus 26.

The second frame member 42 is also provided with a vertically extending member 48 coupled between the horizontally extending members 44 and 46 at each end thereof. The spaced horizontally extending members 44 and 46 are aligned adjacent to a corresponding one of the horizontally extending members 34 and 36, respectively, and is coupled thereto to extend perpendicularly therefrom. Additionally the vertically extending members 48 are aligned adjacent to a corresponding one of the vertically extending members 38 and are coupled thereto to extend perpendicularly therefrom. As a result, the frame member 42 is perpendicularly coupled to the frame member 32 so that it extends perpendicularly therefrom into the opening 40.

The ventilation panel 26 is also provided with a pair of window frames, generally designated, by the numerals, 54 and 56 (FIG. 4). The window frame 54 is coupled to the frame member 42 in the frame opening 40. The window frame 54 is provided with upper and lower spaced horizontally extending channels 58 and 60 which extend about halfway along the members 44 and 46 and a vertically extending channel 62 (FIGS. 3 and 4) coupled to the horizontal channels at each outermost end thereof (FIG. 3) thereby forming a rectangular shape window frame 64 in a first portion of the frame opening 40. A window 66 is coupled in the channels 58, 60 and 62 of the window frame 54 thereby covering the first portions of the frame opening 40. The window 66 may be made for example, of glass or Plexiglas™. The second window frame 56 is provided with an upper and lower spaced horizontally extending tracks 68 and 70 which are coupled adjacent to corresponding ones of the channels 58 and 60 respectively on the frame member 42. The tracks 68 and 70 are coupled in the frame opening 40 to extend the length of the opening. A vertically extending track 72 is coupled to extend between the tracks 68 and 70 at each outermost end thereof thereby forming the rectangular shaped window frame 56. An intermediate vertically extending member 74 (FIG. 3) is coupled to extend between the tracks 68 and 70 at an intermediate portion thereof and an end member 76 is coupled to extend between the horizontal tracks at one end thereof to form window frame 78 in a second portion of the frame opening 40. The frame 78 is the same size as the frame 54. A window 82 is coupled in the window frame 78 and the frame is slidably mounted in the frame 56 so that the window 82 can be selectively moved to fully or partially cover the second portions of the frame opening 40 thereby providing ventilation into the garage 10 as desired. The window 82 may be made, for example, of glass or Plexiglas™. A window locking member, generally designated, by the numeral, 84 having locking portions 86 and 88 which lockingly engage each other in a well known manner is provided to lockingly securing the window 82 in place. The ventilation panel 26 may also be provided with a screen member 90 (FIGS. 1 and 2) which can be removably secured in the frame in a well known manner to cover the windows 66 and 82 when desired.

The ventilation panel 26 is also provided with a plurality of coupling members, generally designated, by the numeral, 91 formed on the horizontal and vertical frame members 34 and 36 respectively. The coupling members 91 are provided to couple the ventilation panel 26 to the garage door panel 14 of the garage door 12. The coupling members 91 (FIGS. 4,7,8 and 10) each includes an elongated member 91*a* having female-like coupling threads formed therein for receiving a elongated member 91*b* having male-like coupling threads formed thereon. This allows elongated member 91*a* to couplingly engage elongated member 91*b*. The elongated member 91*a* is positioned on the frame member so that one end thereof is aligned adjacent to the frame member. The coupling member 91 further includes nut and bolt assembly 95 having portions thereof which extends through the garage door panel 14 so that the planar shaped member 93 can be coupled at the other end thereof to the garage door panel 14. By utilizing the coupling member 91 at predetermined positions on the horizontal and vertical frame members 34 and 36 respectively, the venting apparatus 26 can be properly secured to the garage door in the opening 28. The elongated member 91*a* is positioned on the frame member so that one end thereof is aligned adjacent to the frame member. The coupling member 91 also includes a planar shaped member 93 which is couplable at one end thereof to the elongated member 91*a* at the other end thereof.

Figure 5:
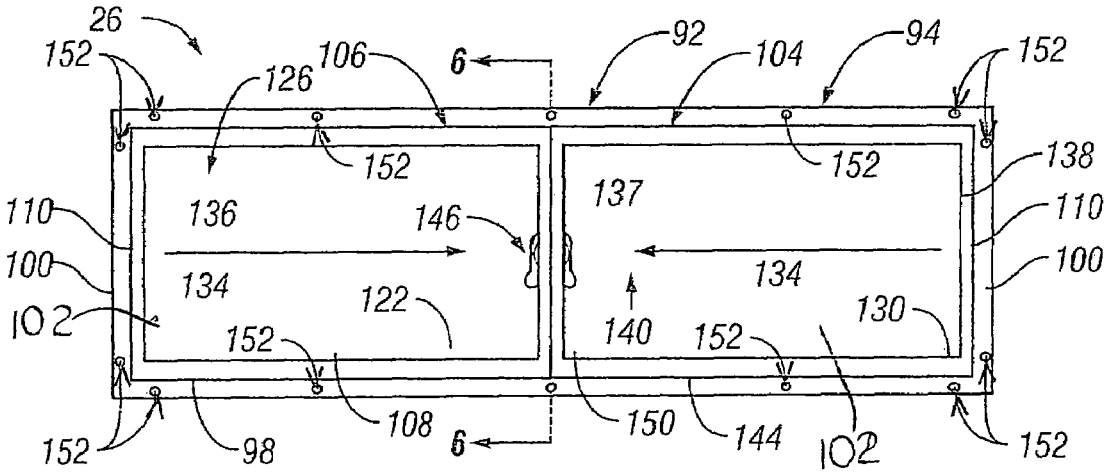
FIG. 5 is a front plain view illustrating a second embodiment of a garage door ventilation apparatus in accordance with the principles of the invention.
Figure 6:
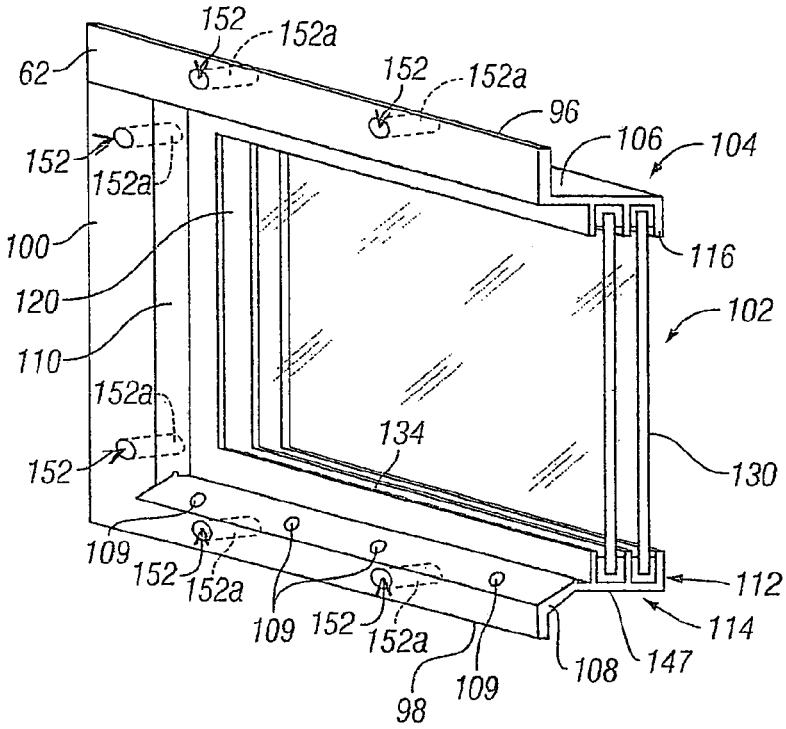
FIG. 6 is a cross sectional view taken along line 6—6 of FIG. 5.
Figure 7:
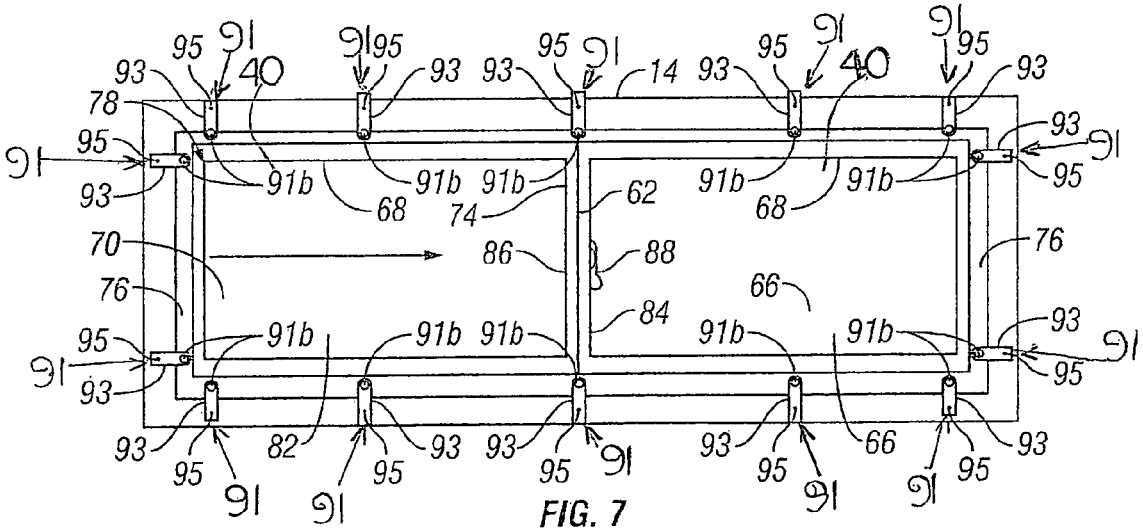
FIG. 7 is a back plain view illustrating the first embodiment of a garage door ventilation apparatus in accordance with the principles of the invention.
Figure 9:
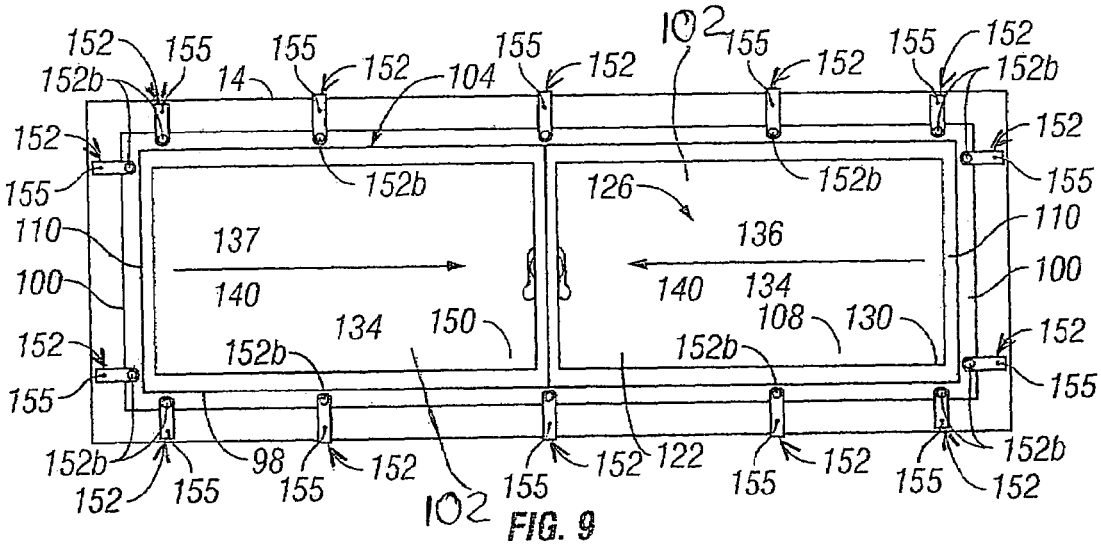
FIG. 9 is a back plain view of the second embodiment of a garage door ventilation apparatus in accordance with the principles of the invention.

Referring to FIGS. 5 6 and 9, a second embodiment of the ventilation panel 26 is provided with a frame assembly, generally designated, by the numeral, 92. The frame assembly 92 is provided with a first rectangular planar shaped frame member, generally designated, by the numeral, 94. The planar shaped member 94 is provided with an upper horizontally extending member 96 and a spaced lower horizontally extending member 98. The planar shaped member 92 is also provided with a vertically extending member 100 coupled between each end of the horizontally extending members 96 and 98 thereby forming a frame opening 102. The frame assembly 92 is provided with a second rectangular shaped frame member, generally designated, by the numeral, 104. The second frame member 104 is provided with an upper horizontally extending member 106 and a spaced lower horizontally extending member 108. The spaced lower horizontally extending member 108 has a downward pitch so that excess water will not accumulate on the ventilation panel 26. The spaced lower horizontally extending member 108 also has a plurality of apertures 109 formed therein to further prevent water from accumulating on the panel 26. The frame member 104 is also provided with a vertically extending member 110 coupled between the horizontally extending members 96 and 98 at each end thereof. The frame assemblies 104 and 92 are perpendicularly coupled together as are the frame assemblies 30 and 42 in FIG. 4 so that the frame assembly 104 extends perpendicularly from the frame assembly 92 into the frame opening 102.

The ventilation panel 26 is also provided with a pair of window frames, generally designated, by the numeral 119 and 114. The window frame 112 is coupled to the frame member 104 in the frame opening 102. The window frame 112 is provided with upper and lower spaced horizontally extending tracks 116 and 118 and a vertically extending track 120 (only one shown) coupled together to form the rectangular shape window frame 112. An intermediate vertically extending member 122 is coupled to extend between the tracks 116 and 118 at an intermediate portion thereof and an end member 124 is coupled to extend between the horizontal tracks at an end thereof to form a window frame 126 in a first portion of the window opening in the frame opening 102. A window 130 is coupled in the window frame 126 and the frame is slidably mounted in the frame 112 so that the window can be selectively moved into and out of the first portion of the opening 102. The window 130 may be made, for example, of glass or Plexiglas™.

Figure 8:
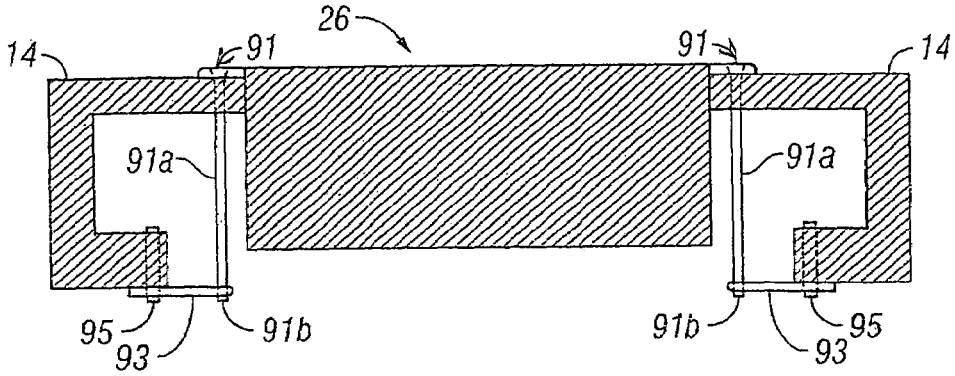
FIG. 8 is a cut away view of the garage including the first embodiment of a garage door ventilation apparatus illustrating a coupling member in accordance with the principles of the invention.
Figure 10:
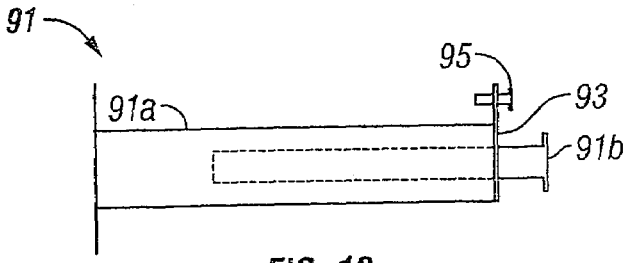
FIG. 10 is a side view of the coupling member of the garage door ventilation apparatus in accordance with the principles of the invention.

The window frame 114 is coupled adjacent to the window frame 112 on frame member 104. The window frame 114 is provided with an upper and lower horizontally extending tracks 132 and 134 and a vertically extending track 136 vertically coupled between the tracks 132 and 134 at outermost ends to form the rectangular window frame 114 (FIG. 6). An intermediate vertically extending member 137 (FIG. 5) is coupled to extend between the tracks 132 and 134 at an intermediate portion thereof and end member 138 is coupled to extend between the horizontal tracks at an end thereof to form a window frame 140 in a second portion of the opening 102. A window 144 is coupled in the window frame 140 and the frame is slidably mounted in the frame 114 so that the window can be selectively moved into and out of the second portion of the opening 102. The window 144 may be made, for example, of glass or Plexiglas™. A window locking member, generally designated, by the numeral, 146 is provided having locking portions 148 and 150 which lockingly engage each other in a well known manner to lockingly secure the windows 130 and 144. The ventilation panel 26 may also be provided with a screen member (not shown) as is illustrated in FIG. 2. The ventilation panel 26 is also provided with a plurality of coupling members, generally designated, by the numeral, 152 formed on the horizontal and vertical frame members 96 and 98. The coupling members 152 are provided to couple the panel 26 to the garage door panel 14 of the garage door 12, and are of the same configuration as coupling members 91 in the first embodiment (FIGS. 8 and 10). The coupling members 152 include an elongated member 152*a* having female threads formed therein for receiving a screw 152*b* having male threads formed thereon. The coupling member 152 also has an elongated flat member 153 pivotably coupled at the end thereof to the elongated member 152*a* to couple the venting apparatus 26 to the inside of the garage door panel 14. The elongated member 153 has a nut and bolt assembly 155 coupled to the other end thereof to facilitate attaching the panel 26 to the inside of the panel 14.

The invention has been shown and described in what is considered to be the most practical and preferred embodiment. However, it should be recognized that changes may be made by those skilled in the art without departing from the spirit and scope of the invention.

The invention claimed is:

1. A ventilation apparatus for mounting in a garage door including:

a rectangular shaped base support member, the base support member including a first pair of spaced aligned horizontally extending members, a first pair of spaced aligned vertically extending members, one of the vertically extending members being coupled between each end portion of the pair of horizontally extending members so that an opening is formed in the base support member between the first pair of horizontally extending members and the first pair of spaced aligned vertically extending members, a second pair of spaced aligned horizontally extending members, each one of the second pair of horizontally extending members being perpendicularly coupled to one of the first pair of horizontally extending members, and the lower horizontally extending member of the second pair of horizontally extending members having a downward pitch and apertures formed thereon to allow water to drain therefrom, a second pair of spaced vertically extending members, each one of the second pair of vertically extending members being perpendicularly coupled to one of the first pair of vertically extending members; a first rectangular shaped channel member having an opening formed therein, aligned in a first portion of the base support member opening, the first rectangular shaped channel member including a first pair of spaced aligned horizontally extending channels each one of the channels being coupled to one of the second horizontally extending members, and a first pair of spaced aligned vertically extending channels one of the vertically extending channels being coupled between each outermost end portion of the pair of horizontally extending channels on an adjacent one of the second pair of spaced vertically extending members;

a first transparent member coupled in the first tracking member;

a second rectangular shaped tracking member having an opening formed therein the second rectangular shaped tracking member being aligned in the entire base support member opening, the second rectangular shaped tracking member including a second pair of spaced aligned horizontally extending tracks aligned adjacent to the first pair of horizontally extending tracks, and a second pair of spaced aligned vertically extending tracks aligned adjacent to the first pair of vertically extending tracks, one of the second vertically extending tracks being coupled between each outermost end portions of the second pair of horizontally extending tracks;

a second transparent member mounted for slidable movement in the second tracking member opening so that the second transparent member can be moved in the second tracking member opening to a first position in adjacent alignment with the first transparent member causing a second portion of the base support member opening to be covered and can be moved to a second position out of the adjacent alignment with the first transparent member causing a second portion of the base support member opening to be uncovered; and a plurality of predetermined spaced coupling members having portions thereof formed on the rectangular shaped base support member and portions thereof in engaging alignment with an uppermost panel of a garage door for facilitating the attaching of the rectangular shaped base support member to the uppermost panel of the garage door, the plurality of spaced aligned coupling members including a first elongated member having coupling threads formed therein and having one end thereof aligned adjacent the base support member, a second elongated member having coupling threads formed thereon, for couplingly engaging the first elongated member, a planar shaped member couplable at one end thereof to another end of the first elongated member when the second elongated member couplingly engages the first elongated member, and a fastening member having portions thereof which couplingly engages the uppermost panel of the garage door and other portions thereof which couplingly engages another end of the planar shaped member.

2. A ventilation apparatus as defined in claim 1 further including a means supported in the opening in the base support member for covering the first and second transparent members.

3. A ventilation apparatus as defined in claim 2 wherein the first transparent member includes a piece of Plexiglas™.

4. A ventilation apparatus as defined in claim 3 wherein the second transparent member includes a piece of Plexiglas™.

5. A ventilation apparatus as defined in claim 4 wherein the covering means includes a screen.

6. A ventilation apparatus for mounting in a garage door including:

a rectangular shaped base support member, the base support member including a first pair of spaced aligned horizontally extending members, a first pair of spaced aligned vertically extending members, one of the spaced aligned vertically extending members being coupled between each end portion of the pair of spaced aligned horizontally extending members so that an opening is formed in the base support member between the first pair of spaced aligned horizontally extending members and the first pair of spaced aligned vertically extending members, a second pair of spaced aligned horizontally extending members, each one of the second pair of spaced aligned horizontally extending members being perpendicularly coupled to one of the first pair of spaced aligned horizontally extending members, and the lower horizontally extending member of the second pair of horizontally extending members having a downward pitch and apertures formed thereon to allow water to drain therefrom, a second pair of spaced aligned vertically extending members, each one of the second pair of spaced aligned vertically extending members being perpendicularly coupled to one of the first pair of spaced aligned vertically extending members;

a first rectangular shaped tracking member having an opening formed therein, aligned in the base support member opening, the first rectangular shaped tracking member includes a first pair of spaced aligned horizontally extending tracks each one of the tracks being coupled to one of the second pair of spaced aligned horizontally extending members, and a first pair of spaced aligned vertically extending tracks, one of the first pair of vertically extending tracks being coupled between each outermost end portion of the pair of horizontally extending tracks on an adjacent one of the second pair of spaced vertically extending members;

a first transparent member slidably coupled in the first tracking member opening so that the first transparent member can be moved to a position so first portions of the base support member opening are closed and can be moved to another position so that the opening is open;

a second rectangular shaped tracking member having an opening formed therein aligned in the base support member opening adjacent the first rectangular shaped tracking member, the second rectangular shaped tracking member including a second pair of spaced aligned horizontally extending tracks aligned adjacent to the first pair of spaced aligned horizontally extending tracks, and a second pair of spaced aligned vertically extending tracks aligned adjacent to the first pair of spaced aligned vertically extending tracks, one of the second pair of spaced aligned vertically extending tracks being coupled between each outermost end portions of the second pair of spaced aligned horizontally extending tracks;

a second transparent member mounted for slidable movement in the second tracking member opening so that the second transparent member can be moved to a position to cover second portions of the base support member opening and so that the second transparent member can be moved to a position so that the second portions of the base support member opening are uncovered; and a plurality of predetermined spaced coupling members having portions thereof formed on the rectangular shaped base support member and portions thereof in engaging alignment with an uppermost panel of a garage door for facilitating the attaching of the rectangular shaped base support member to the uppermost panel of the garage door, each one of the plurality of spaced aligned coupling members including a first elongated member having coupling threads formed therein and having one end thereof aligned adjacent the base support member, a second elongated member having coupling threads formed thereon, for couplingly engaging the first elongated member; a planar shaped member couplable at one end thereof to another end of the first elongated member when the second elongated member couplingly engages the first elongated member, and a fastening member having portions thereof which couplingly engages the uppermost panel of the garage door and other portions thereof which couplingly engages another end of the planar shaped member.

7. A ventilation apparatus as defined in claim 6 wherein the first transparent member includes a piece of Plexiglas™.

8. A ventilation apparatus as defined in claim 7 wherein the second transparent member includes a piece of Plexiglas™.

9. A ventilation apparatus as defined in claim 8 wherein the covering means includes a screen.

10. A ventilation apparatus as defined in claim 9 further including a covering means for covering the transparent members.

11. A ventilation apparatus as defined in claim 10 wherein the covering means includes a screen.

* * * * *